US005389511A

United States Patent [19]

Nakayama

[11] Patent Number: 5,389,511

[45] Date of Patent: Feb. 14, 1995

[54] SILVER HALIDE PHOTOGRAPHIC EMULSION AND LIGHT-SENSITIVE SILVER HALIDE PHOTOGRAPHIC MATERIAL MAKING USE OF THE SAME

[75] Inventor: Tomoyuki Nakayama, Hino, Japan

[73] Assignee: Konica Corporation, Tokyo, Japan

[21] Appl. No.: 200,563

[22] Filed: Feb. 18, 1994

Related U.S. Application Data

[63] Continuation of Ser. No. 972,420, Nov. 5, 1992, abandoned.

[30] Foreign Application Priority Data

Nov. 6, 1991 [JP] Japan ..... 3-317268

[51] Int. Cl.[6] ..... G03C 1/09

[52] U.S. Cl. ..... 430/600; 430/603; 430/605

[58] Field of Search ..... 430/600, 603, 605

[56] References Cited

U.S. PATENT DOCUMENTS

| | | | |
|---|---|---|---|
| 1,574,944 | 3/1926 | Sheppard | 430/603 |
| 1,602,592 | 10/1926 | Sheppard | 430/603 |
| 1,623,499 | 4/1927 | Sheppard et al. | 430/603 |
| 2,131,038 | 9/1938 | Brooker et al. | 430/614 |
| 2,278,947 | 4/1942 | Riester | 430/600 |
| 2,410,689 | 11/1946 | Sheppard et al. | 430/603 |
| 2,688,545 | 9/1954 | Carroll et al. | 430/573 |
| 2,728,668 | 12/1955 | Mochel | 430/600 |
| 2,912,329 | 11/1959 | Jones et al. | 430/550 |
| 3,397,060 | 8/1968 | Schwan et al. | 430/550 |
| 3,411,914 | 11/1968 | Dostes | 430/606 |
| 3,501,313 | 3/1970 | Willems et al. | 430/603 |
| 3,554,757 | 1/1971 | Kuwabara et al. | 430/543 |
| 3,615,635 | 10/1971 | Shiba et al. | 430/576 |
| 3,628,964 | 12/1971 | Shiba et al. | 430/574 |
| 3,656,955 | 4/1972 | Ushimaru et al. | 430/600 |
| 4,906,558 | 3/1990 | Mücke et al. | 430/603 |

FOREIGN PATENT DOCUMENTS

| | | |
|---|---|---|
| 0122125 | 10/1984 | European Pat. Off. . |
| 0294149 | 12/1988 | European Pat. Off. . |
| 0302528 | 2/1989 | European Pat. Off. . |
| 3198042 | 8/1991 | Japan . |
| 2113415 | 8/1983 | United Kingdom . |

OTHER PUBLICATIONS

"Effects of Tetraazaindene on Reaction and Aggregation Processes in Sulfur Sensitization with Thiosulfate," Journal of Imaging Science, vol. 32, No. 1, Feb. 1988, H. Takiguchi, pp. 20–27.

Patent Abstract of Japan, vol. 13, No. 426 (P-935) 22 Sep. 1989, for JP 1158425 dated 21 Jun. 1989.

"Model for the Chemical Sensitization of Silver Halide Photographic Emulsion with Sulfur and Gold," D. A. Pitt et al., Photographic Science and Engineering, vol. 25, No. 2, Mar./Apr. 1981, pp. 57–62.

*Primary Examiner*—Janet C. Baxter

*Attorney, Agent, or Firm*—Finnegan, Henderson, Farabow, Garrett & Dunner

[57] ABSTRACT

A silver halide photographic emulsion improved in low-intensity reciprocity law failure is provided, in which the silver halide emulsion contains silver halide grains having thereon chemical sensitization nuclei produced during chemical sensitization wherein the nuclei substantially consist of at least two groups of chemical sensitization nucleuses, the groups having different nucleus-size frequency distributions from each other.

6 Claims, 1 Drawing Sheet

SILVER HALIDE PHOTOGRAPHIC EMULSION AND LIGHT-SENSITIVE SILVER HALIDE PHOTOGRAPHIC MATERIAL MAKING USE OF THE SAME

This application is a continuation of application Ser. No. 07/972,420, filed Nov. 5, 1992, now abandoned.

FIELD OF THE INVENTION

The present invention relates to a silver halide photographic emulsion and a light-sensitive silver halide photographic material comprising the emulsion. More particularly it relates to a silver halide photographic emulsion containing silver halide grains having a novel chemically sensitizing nucleus structure and a light-sensitive silver halide photographic material making use of it.

BACKGROUND OF THE INVENTION

In recent years, there are increasingly severe demands on silver halide photographic emulsions, which are directed to photographic performances at still higher levels, e.g., higher sensitivity, superior graininess, higher sharpness, lower fog density and more sufficiently high optical density. In most cases, these demands apparently considered different from each other can be settled by techniques of preparing low-fog and high-speed silver halide emulsions. It is not too much to say that development of such low-fog and high-speed silver halide emulsions is a greatest subject in the present industrial field.

A most suitable method for achieving a higher sensitivity is to decrease inefficiency in the process of latent image formation of silver halide crystals so that the quantum efficiency in latent image formation can be improved. As a conventional means for improving this quantum efficiency, chemically sensitizing nuclei composed of silver sulfide, gold sulfide or a mixture of these that function as sensitivity centers capable of capturing free electrons are imparted so as to be formed on the surfaces, or in the insides, of silver halide crystals. This is commonly known as sulfur sensitization or gold-sulfur sensitization.

However, an attempt to use conventional chemical sensitization to form sensitizing nuclei having a good electron capture efficiency is known to result in the formation of a large number of sensitizing nuclei, which causes free-elecrtron capture competition between sensitizing nuclei to bring about a decrease in efficiency of latent image formation, i.e., a decrease in sensitivity. In addition, the size and physicochemical properties of a plurality of chemically sensitizing nuclei formed on the surfaces or insides of silver halide grains have not necessarily been made uniform.

As a means of overcoming the disadvantages in the conventional methods, techniques have been proposed in which chemical sensitization is carried out in the presence of what is called a chemical sensitization controlling agent or chemical sensitization modifier, to control the process of formation of chemical sensitization specks. For example, Japanese Patent Publication Open to Public Inspection (hereinafter referred to as Japanese Patent O.P.I. Publication) No. 126526/1983, U.S. Pat. Nos. 2,131,038, 3,411,914 and 3,554,757, and G. F. Duffin, "Photographic Emulsion Chemistry", The Focal Press Co., 1966, pp.138–143 disclose such techniques.

Various methods aiming at improving latent image forming efficiency by controlling the position of chemically sensitizing nuclei formed on silver halide grains are also disclosed in Japanese Patent O.P.I. Publications No. 93447/1986, No. 40938/1989, No. 62631/1989, No. 745540/1989, No. 201651/1989, No. 272743/1989, No. 345/1990 and No. 298935/1990. Japanese Patent O.P.I. Publication No. 158425/1989 discloses that the sensitivity efficiency can be improved by controlling the nucleus number ratio of chemically sensitizing nuclei on (100) face to those on (111) face in grains having (100) face and (111) face.

As a result of our studies, however, it has been revealed that the level of the recent demand for higher sensitivity can not be well achieved by these measures for improvements. That is, in these techniques in which the position or number of chemically sensitizing nuclei is controlled, what is intended is achieved basically by limiting the reaction areas of chemical sensitizers on silver halide grains, so that the reaction must be made to take place in relatively narrow regions to bring about the disadvantage that the control of the reaction process of chemical sensitization is so difficult that an attempt to sufficiently increase sensitivity tends to result in an increase in fog. Moreover, these techniques may be accompanied with an increase in low intensity reciprocity law failure and can not well satisfy the performances required in light-sensitive materials for photographing.

Meanwhile, Japanese Patent O.P.I. Publication No. 19804/1991 discloses a silver halide emulsion comprising grains on each surface of which two kinds of chemically sensitizing nuclei containing chalcogenides with different properties are present together. The disclosure in this publication, however, shows that one sensitizing nuclei preferentially increase the internal sensitivity of a silver halide grain. This is therefore clearly different from the constitution of the chemically sensitizing nuclei according to the present invention.

This publication has no disclosure as to the size of such sensitizing nuclei and also has no detailed disclosure as to the means for achieving the intended features. In addition, for the chemically sensitizing nuclei containing a chalcogenide capable of preferentially increasing the internal sensitivity as disclosed in that publication, it is difficult to be made stably present in an emulsion having been subjected to gold-sulfur sensitization, causing a problem of deterioration of storage stability of light-sensitive materials.

SUMMARY OF THE INVENTION

A first object of the present invention is to provide a silver halide photographic emulsion having a high sensitivity and a low fog and causing less low-intensity reciprocity law failure.

A second object of the present invention is to provide a silver halide photographic emulsion having a high sensitivity and capable of improving image quality.

As a result of extensive studies, the present inventors have discovered that the above objects of the present invention can be achieved by a silver halide photographic emulsion constituted as described below and a light-sensitive silver halide photographic material comprising such an emulsion.

A silver halide photographic emulsion comprising silver halide grains comprising a grain having thereon chemically sensitizing nuclei having at least two distinctive groups in their size distribution.

DETAILED DESCRIPTION OF THE INVENTION

Figure 1:
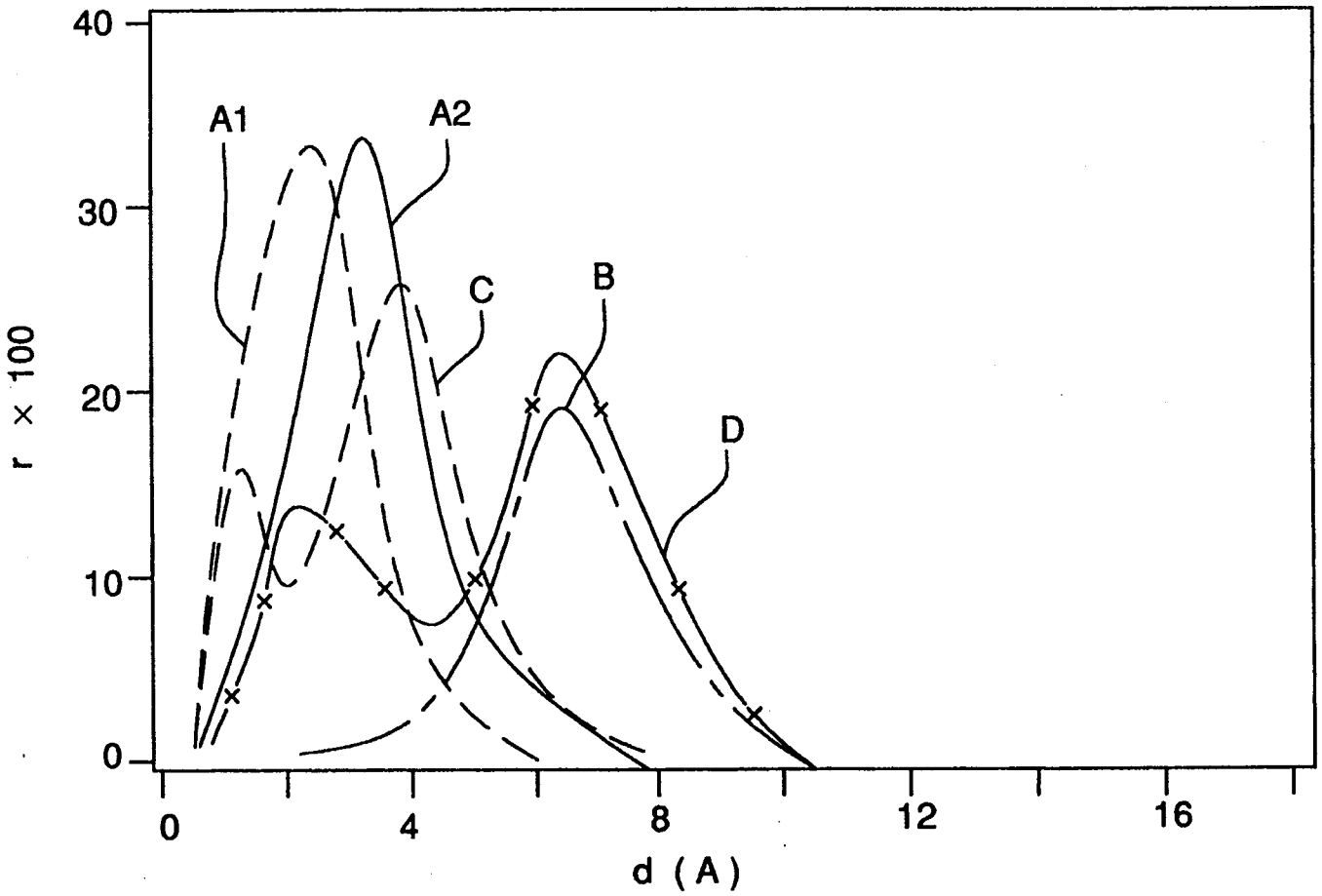
FIG. 1 shows size-frequency distribution curves of chemically sensitizing nuclei, obtained by observing emulsions A1, A2, B, C and D by the gelatin shell method.

The size, number, state of distribution and so forth of chemically sensitizing nuclei formed on silver halide grains contained in the silver halide emulsion of the present invention can be analyzed, for example, by observation with an electron microscope. Examples thereof are described in G. C. Farnell et el., J. Photogr. Sci., 25, 204 (1977) and D. Schrijver et el., Draft Collections in the 43rd SPSE Annual Meeting. They can be analyzed according to the methods described therein.

In any cases, it is preferred to use a method in which an electron microscope image or a photograph image thereof is analyzed using an image processing analyzer.

This method can be exemplified by what is called gelatin shell method, i.e., a method in which a silver halide emulsion having been subjected to chemical sensitization is dissolved with a silver halide solvent such as sodium thiosulfate and thereafter chemically sensitizing nuclei such as silver sulfide nuclei remaining on gelatin that has covered a silver halide grain are counted and measured using an electron microscope.

What is meant by "having at least two distinctive groups in size distribution" referred to in the present invention is "having peaks or a bottom respectively interposed between at least two bottoms or peaks in a differential curve with respect to the distribution of the projected areas of chemically sensitizing nuclei as measured by the gelatin shell method described above.

The distribution calculated as projected areas is expressed by;

$$r(s_j)=s_jn_j/\Sigma S_jn_j$$

wherein $s_j$ represents a projected area of a chemically sensitizing nucleus, $n_j$ represents the number of chemically sensitizing nuclei having the projected area $s_j$, and $r(s_j)$ represents an area ratio of the chemically sensitizing nuclei having the projected area $s_j$ to the projected areas of the whole chemically sensitizing nuclei. The size of a chemically sensitizing nucleus can be expressed, for example, by a diameter $d_j$ calculated as a circle having an area equal to the projected area $s_j$.

What is defined by the silver halide photographic emulsion of the present invention, comprising silver halide grains comprising a grain having thereon a group of chemically sensitizing nuclei having at least two distinctive groups in their size distribution, is concerned with size distribution of chemically sensitizing nuclei present on one silver halide grain contained in the emulsion. An example in which an emulsion is obtained by mixing two or more kinds of emulsions containing silver halide grains having different size of chemically sensitizing nuclei on a grain does not fall under the present invention.

In the present invention, the sensitizing nuclei may preferably have at least two distinctive peaks in their size distribution curve. In this instance, what is meant by "have two distinctive peaks" is that a minimum value between two peaks is not more than 80% of a value r of a lower peak between the two peaks.

Chemically sensitizing nuclei that constitute a mass having the distribution with the largest projected area may preferably be present on the corner or edge of a silver halide grain.

Whether or not the sensitizing nuclei have a plurality of groups in their size distribution can be examined also by the physical evaluation method well known in the present industrial field.

In general, the sensitizing nuclei form a minute cluster of several nanometers or less in size. As properties of such a substance, it has been made clear that the highest occupied electron level and lowest unoccupied electron level are sensitive to the size of the cluster. Accordingly, for example, the energy level at which the chemically sensitizing nuclei capture free electrons on a silver halide will vary depending on the size. Hence, whether or not the sensitizing nuclei are formed of masses having plural kinds of size can be judged by examining the distribution of their electron capture levels.

As a method for measuring the electron capture levels, a method has been proposed in which they are determined from an activation energy of photoelectron lifetime according to the microwave photoconductivity measurement well known in the present industrial field, as disclosed by Takuji Kaneda in Fuji Photo Film Research Reports, No. 36, page 18.

The microwave photoconductivity measurement can be carried out by making reference to, e.g., L. M. Kellog, Photogr. Sci. Eng., 18 (1974), 378.

The microwave photoconductivity measurement carried out by the present inventors was made under the following conditions.

A light-sensitive silver halide photographic material placed in a microwave guide circuit was measured using an X-band microwave signal measuring system. An argon-hydrogen gas mixing discharge tube with a pulse half-width of about 50 nanoseconds was used as an irradiation light source, and UVD-33S and IRA-20 filters, available from Toshiba Corporation, were used. Irradiation was made in an amount of light of $10^{12}$ photons/cm$^2$.

Microwave photoconducting signals after the irradiation with light on each emulsion sample in Example 2 of the present invention showed a substantially first decay process. Based on temperature changes of the first order decay time $\tau$, the depth of electron capture centers formed by chemical sensitization , i.e., the depths of chemically sensitizing nuclei were measured according to the method described in T. Kaneda, Journal of Imaging Science, Vol. 33 (1989), pp.115–118.

As a result of extensive studies, the present inventors have discovered that, depending on how chemical ripening is carried out, the chemically sensitizing nuclei show different values in the activation energy determined by the microwave photoconductivity measurement. They have also discovered that a high sensitivity can be obtained when chemically sensitizing nuclei that impart different activation energies are combined.

Thus, in the present invention, what is meant by "having at least two distinctive groups in size distribution", when its definition is made using the activation energy, can be said to include a chemical sensitization structure formed by combination of the chemically sensitizing nuclei that impart different activation energies.

In the present invention, the chemically sensitizing nuclei are capable of increasing the surface sensitivity of a silver halide emulsion.

Definition on the chemically sensitizing nuclei capable of increasing the surface sensitivity, as referred to in the present invention, will be described below. The chemically sensitizing nuclei capable of increasing the surface sensitivity refer to those in which relative sensitivities $ds_s$ and $ds_i$ to chemically unsensitized emulsion grains subjected to the surface or internal development as shown below are $ds_s \geqq ds_i$. Herein $ds_s$ represents e relative sensitivity obtained by surface development of the emulsion grains subjected to chemical sensitization, assuming as 100 the sensitivity obtained by surface development of the chemically unsensitized emulsion grains, and $ds_i$ represents a relative sensitivity obtained by internal development of the emulsion grains subjected to chemical sensitization, assuming as 100 the sensitivity obtained by internal development of the chemically unsensitized emulsion grains.

Surface developing solution

| | |
|---|---|
| Methol | 2.5 g |
| L-ascorbic acid | 10 g |
| Sodium metaborate (tetrahydrate) | 35 g |
| KBr | 1 g |
| Made up to 1 liter by adding water. | |

Using the above developing solution, processing is carried out for 10 minutes to effect the surface development.

| | |
|---|---|
| Red prussiate | 3 g |
| Phenosafranine | 0.0125 g |
| Made up to 1 liter by adding water. | |

After the surface latent image has been bleached using the above bleaching solution, washing is carried out for at least 10 minutes, followed by processing at 20° C. for 10 minutes to effect the internal development, using a developing solution prepared by adding 6 g per liter of hypo to the above surface developing solution.

A method for obtaining the chemically sensitizing nuclei used in the present invention will be described below.

A group of chemically sensitizing nuclei having on their each grain at least two distinctive groups in their size distribution can be formed by a method including the following:

(1) A method in which the adsorption density of the chemically sensitizing agent on the silver halide grain surface is made different for each region on the grain.

(2) A method in which the rate of migration and aggregation of atoms and groups of atoms constituting the chemically sensitizing nuclei on the silver halide grain surface, such as chalcogen atoms, chalcogenide compounds, noble metal atoms or noble metal compounds, is made different for each region on the grain.

(3) A method in which atoms or groups of atoms, or lattice defects, that serve as aggregation nuclei with respect to the atoms or groups of atoms constituting the chemically sensitizing nuclei, such as chalcogen atoms, are imparted to only specific region(s) on each silver halide grain, or to each grain while making their density different for each region on the grain. In this instance, gold atoms or groups of gold atoms are preferred as the aggregation nuclei, and such aggregation nuclei may preferably be imparted using a gold sensitizer having a certain face selectivity.

The method (1) may more specifically include the following:

(a) A method in which a compound I capable of being preferentially adsorbed on silver halide grain surfaces having a specific face index is added, followed by addition of a chemical sensitizer II to carry out chemical ripening to form a chemically sensitizing nuclei group I having a certain size distribution. Thereafter the compound I is released from the surfaces and then the chemical sensitizer II is again added to form a chemically sensitizing nuclei group II having a different size distribution than the sensitizing nuclei group I. In this instance, the compound I and the sensitizer II may preferably have different face selectivities.

(b) A method in which chemical sensitizers having different face selectivities are used in combination to control the adsorption density of chemical sensitizers and decomposition reaction thereof on the grain surfaces each having different face indices, to thereby form chemically sensitizing nuclei having different groups in size distribution for each face on the surface.

In this method, a chalcogen compound as specifically described later may be used, where, for example, triethylthiourea, 1-ethyl-3-(2-thiazolyl)thiourea or the like may be used as a (100) face selectivity compound and sodium thiosulfate may be used as a (111) face selectivity compound. The method (b) is preferred in view of a less influence on other process in the chemical ripening step and also an easier control of the size of the sensitizing nuclei.

Japanese Patent O.P.I. Publications No. 40938/1989 and No. 62631/1989 disclose a method in which a chemical sensitizer and a compound with adsorptivity to silver halide, having different face selectivities from each other, are used so that sensitizing nuclei are preferentially imparted to the face having a certain face index on the surface.

In these publications, however, only the nucleus number of sensitizing nuclei formed on a face having a certain face index is defined and no reference is made to the controlling of size frequency distribution of chemically sensitizing nuclei. There is also no disclosure as to the method of forming the sensitizing nuclei having different groups in their size distribution. Thus, what is disclosed therein is different from the present invention in its technical idea and method.

The method (2) may include, for example, the following:

(a) A method in which a chemical sensitizer is added to form a sensitizing nuclei group I and thereafter, during the step of chemical ripening, ripening conditions such as temperature, pAg and pH are so changed that the rate of migration or aggregation of atoms and groups of atoms constituting the chemically sensitizing nuclei on silver halide grains is made different, followed by further addition of a chemical sensitizer to form a sensitizing nuclei group II having a different size distribution from that of the sensitizing nuclei group I. In this instance, no gold sensitizer may preferably be added before the chemical sensitizer used to form the sensitizing nuclei group II is added.

(b) A method in which a chemical sensitizer is added to form a sensitizing nuclei group I and thereafter a compound with adsorptivity to silver halide grain surfaces is added, followed by further addition of a chemical sensitizer to form a sensitizing nuclei group II. In this instance, no gold sensitizer may preferably be added before the chemical sensitizer used to form the sensitizing nuclei group II is added.

The chemical sensitizer and the adsorptive compound may preferably have the same face selectivity.

The chemical sensitizers added before and after the adsorptive compound is added may be the same or different from each other. In the case when the chemical sensitizers are different, the adsorptive compound may have the same face selectivity as any of the chemical sensitizers.

The chalcogen compound used in the present invention may include sulfur-containing compounds, selenium-containing compounds and tellurium-containing compounds. In photographic usage, sulfur-containing compounds and selenium-containing compounds are preferred.

As the sulfur-containing compounds, known compounds can be used. For example, they may include thiosulfates, allylthiocarbamides, thioureas, allylisothiocyanate, cystine and rhodanine. It is also possible to use sulfur sensitizers disclosed in U.S. Pat. Nos. 1,574,944, 2,410,689,2,278,947, 2,728,668, 3,501,313 and 3,656,955, West German Laid-open Application (OLS) No. 14 22 869, and Japanese Patent O.P.I. Publications No. 24937/1981 and No. 45016/1980.

The selenium-containing compounds may include aliphatic isoselenocyanates such as allylisoselenocyanate, selenoureas, selenoketones, selenoamides, selenocarboxylic acids and esters thereof, selenophosphates, and selenides such as diethyl selenide and diethyl diselenide. Examples thereof are disclosed in U.S. Pat. Nos. 1,574,944, 1,602,592 and 1,623,499.

The face selectivity sensitizer referred to in the present invention indicates a sensitizer capable of preferentially forming chemically sensitizing nuclei on a crystal face having a certain face index in the presence of substantially no substance adsorptive to silver halide grain surfaces other than a polymeric dispersion medium. This can be specifically examined by the following methods.

(1) Chemical sensitization is applied by adding a chalcogen sensitizer to a silver halide emulsion containing monodisperse tetradecahedral grains having equal face areas of (100) face and (111) face.

(2) Next, the number and size on each face, of the chemically sensitizing nuclei formed on the grains are observed and measured by the method previously described.

Such a face selectivity of the sensitizer may vary depending on the halogen composition of silver halide grains, and the environment at the chemical ripening, and can not necessarily be absolutely determined from the structure of the sensitizer. In usual instances, those which are known as (100) face selectivity sensitizers include thioureas, rhodanines, oxazolidines, polysulfides and selenoureas.

Stated specifically, those disclosed in Japanese Patent O.P.I. Publication No. 62632/1989, etc. can be used as the (100) face selectivity sensitizers.

As (111) face selectivity sensitizers, they are typified by sodium thiosulfate.

The chalcogen sensitizer may be added in an amount enough to effectively increase the sensitivity of emulsions. An appropriate amount may vary depending on various conditions such as pH, temperature, silver halide grain size and shapes at the time of chemical ripening. It may preferably be added in an amount of from $10^{-7}$ mol to $10^{-3}$ mol per mol of silver halide.

The silver halide emulsion of the present invention may preferably be subjected to gold sensitization in combination. When the gold sensitization is used in combination, gold ions or gold atoms may preferably be contained in chemically sensitizing nuclei having a larger average size.

In the present invention, a gold sensitizer may have a valence of gold of +1 or +3, and various types of gold compounds can be used. As typical examples, it may include chloroauric acids, potassium chloroaurate, auric trichloride, potassium auricthiocyanate, potassium iodoaurate, tetracyanoauric acid, ammonium aurothiocyanate, pyridyltrichlorogold, and a gold-dimethylrhodanine complex.

The amount of the gold sensitizer may vary depending on various conditions. As a standard, it may preferably be in the range of from about $10^{-7}$ to $10^{-1}$ mol per mol of silver halide.

The gold sensitizer may be added at the same time as the chalcogenide compound, or before, during or after the step of chalcogenide sensitization. It may preferably be added in the course of or after the step of chalcogenide sensitization.

In the chemical sensitization in the present invention, sensitization using salts of other noble metals as exemplified by platinum, palladium, iridium and rhodium or complex salts thereof may also be carried out in combination.

It is effective to further use a complex compound of Rh, Pd, Ir or Pt as a compound capable of releasing gold from gold-gelatinate and also promoting the adsorption of gold ions to silver halide grains.

Specific compounds may include $(NH_4)_2(PtCl_4)$, $(NH_4)_2(PdCl_4)$, $K_3(IrBr_6)$, $(NH_4)_3(RhCl_6).12H_2O$. Particularly preferred are ammonium tetrachloroparadate (II). It may be added in an amount ranging 10 to 100 times the gold sensitizer in terms of stoichiometric ratio (molar ratio).

Such a compound may be added at the start, in the course of or after completion of the chemical sensitization. It may preferably be added in the course of the chemical sensitization, and may particularly preferably be added at the same time as the gold sensitizer, or before or after that time.

The chemical ripening used in the present invention may be carried out in the presence of a silver halide solvent as exemplified by a thiocyanate or a thioether. It may also be carried out in the presence of a chemical sensitization auxiliary (a chemical sensitization modifier).

For example, a compound such as 4-hydroxy-6-methyl-1,3,3a,7-tetrazaindene, guanosine or sodium p-toluenesulfinate can be used as the chemical sensitization auxiliary (a chemical sensitization modifier).

Specific examples thereof are disclosed in U.S. Pat. Nos. 2,131,038, 3,411,914 and 3,554,757, Japanese Patent O.P.I. Publication No. 126526/1983, and G. F. Duffin, "Photographic Emulsion Chemistry", The Focal Press Co., 1966, pp.138–143.

The silver halide grains contained in the silver halide emulsion of the present invention will be described below.

The silver halide grains contained in the silver halide emulsion of the present invention may have any halogen composition such as silver bromide, silver chloride, silver chlorobromide, silver iodobromide or silver chloroiodobromide, and can be prepared by the methods as disclosed in P. Glafkides, Chemie et Pysique Photographique, Paul Montel Co., 1967; G. F. Duffin, Photographic Emulsion Chemistry, The Focal Press, 1966; and V. L. Zelikman et al., Making and Coating Photographic Emulsion, The Focal Press Co., 1964.

More specifically, any of the acid method, neutral method and ammonia method may be used. Soluble silver salts and soluble halogen salts may be reacted using any form including the single-jet precipitation, the double-jet precipitation or a combination of these. It is also possible to use a method in which grains are formed in the presence of excess silver ions (what is called the reverse precipitation).

As a form of the double-jet precipitation, it is possible to use a method of keeping constant the pAg in a liquid phase in which silver halides are formed, that is, what is called the controlled double-jet precipitation.

The method disclosed in Japanese Patent Application No. 224002/1988, in which emulsions are prepared by feeding iodide ions using fine silver iodide particles, and the method disclosed in Japanese Patent O.P.I. Publication No. 183417/1989, in which seed grains are made to grow by Ostwald ripening of fine silver iodobromide particles, may also be used.

The silver halide grains contained in the silver halide emulsion of the present invention may have a regular shape such as cubes, octahedrons or tetradecahedrons, may have a irregular crystal form such as spheres, may have twin planes, or may have a composite form comprised of any of these. The silver halide crystals may have a structure including a structure having a substantially uniform composition, a double structure of a core/shell type, or a multi-layer structure. They may mope preferably be grains having in their insides a silver halide phase with a band gap energy smaller than the band gap between the valency band and conduction band of silver halide in the halogen composition at the grain surface layer.

The sensitizing method used in the present invention can be applied also to sensitization of tabular silver halide grains. In the case of tabular twinned crystals, where diameter is calculated as that of a circle having the same area as the projected area of the grain, the ratio of the diameter to a grain thickness may preferably range from 1 to 20, more preferably from 1.2 to less than 8.0, and particularly from 1.5 to less than 5. Such crystals may comprise not less than 60% based on the total projected area.

In the silver halide grains contained in the silver halide emulsion of the present invention, a silver halide with different composition may be joined to the parent silver halide grains by epitaxial joint, or a compound other than the silver halide as exemplified by silver thiocyanate or lead oxide may be joined thereto.

In the course of the formation of silver halide grains or physical ripening thereof, a chalcogen compound such as a sulfur, selenium or tellurium compound or a metal salt or metal complex salt such as a cadmium salt, a zinc salt, a thallium salt, an iridium salt or a complex thereof, a rhodium salt or a complex thereof or an iron salt or an iron complex salt may be made present together. In the emulsion of the present invention, an iron salt or an iron complex salt may particularly preferably be made present together.

The silver halide emulsion of the present invention may preferably be a monodisperse silver halide emulsion.

The grain size can be obtained, for example, by projecting the grain at magnification of 10,000 times to 50,000 times using an electron microscope and measuring the diameter of the grain on a print or the area of the grain when projected. (The number of grains measured may be 1,000 or more at random.)

A highly monodisperse emulsion particularly preferable in the present invention is an emulsion having a breadth of distribution of not more than 20%, and more preferably not more than 15%, which is defined as (grain size standard deviation/average grain size)$\times$100=breadth of distribution (%).

Here the grain size is measured according to the method previously described, and the average grain size is on the arithmetic mean.

$$\text{Average grain size} = \Sigma dini/\Sigma ni$$

The silver halide emulsion of the present invention may preferably have an average grain size of from 0.1 μm to 10.0 μm, more preferably from 0.2 μm to 5.0 μm, and particularly preferably from 0.3 μm to 3.0 μm.

A monodisperse regular crystal emulsion can be produced, for example, by making reference to the methods disclosed in Japanese Patent O.P.I. Publications No. 177535/1984, No. 138538/1985, No. 52238/1984, No. 143331/1985, No. 35726/1985, No. 258536/1985 and No. 14636/1986.

A monodisperse twinned crystal emulsion can be produced, for example, by making reference to the method of growing a spherical seed emulsion, disclosed in Japanese Patent O.P.I. Publication No. 14636/1986.

The halogen compositional structure of the silver halide grains of the present invention may be, for example, of a compositional structure in which silver iodide content in a silver halide grain is high at its inside (the core) and low at its surface layer (the shell), or inversely the silver iodide content is higher at an outermost surface layer than the inside. The structure may be selected according to the purpose for which light-sensitive materials are used.

Examples of the former are disclosed in Japanese Patent Examined Publication No. 13162/1968 and Japanese Patent O.P.I. Publications No. 154232/1982, No. 177535/1984, No. 138538/1985, No. 143331/1985, No.88253/1986 and No. 112142/1986. As for examples of the latter, they are disclosed in Japanese Patent O.P.I. Publications No. 106745/1988, No. 183646/1989, No. 284848/1989, No. 279237/1989, No. 12142/1990 and No. 273033/1989.

With regard to other emulsions optionally used in combination when constituting the emulsion of the present invention, or the light-sensitive material obtained using the emulsion of the present invention (hereinafter often "the light-sensitive material of the present invention"), a substance other than gelatin, having an adsorptivity to silver halide grains may be added when they are prepared (including the preparation of seed emulsions). Such an adsorptive substance is exemplified by sensitizing dyes, compounds or heavy metal ions used in the present industrial field as antifoggants or stabilizers, any of which can be useful. Examples of the adsorptive substance are disclosed in Japanese Patent O.P.I. Publication No. 7040/1987.

In the adsorptive substance, at least one of the antifoggant and the stabilizer may be added when a seed emulsion is prepared. Its addition is preferable in view of a decrease in fogging of the emulsion and an improvement in storage stability.

Of the antifoggants and the stabilizers, heterocyclic mercapto compounds and/or azaindene compounds are particularly preferred. Examples of more preferred heterocyclic mercapto compounds and azaindene compounds are disclosed in Japanese Patent O.P.I. Publication No. 41848/1988.

The amount of the heterocyclic mercapto compound or azaindene compound to be added is not limitative. It may preferably be in the range of from $1\times10^{-5}$ to $3\times10^{-2}$ mol, and mope preferably from $5\times10^{-5}$ to $3\times10^{-3}$ mol. This amount should be appropriately selected according to conditions for the preparation of silver halide grains, average grain size of silver halide grains, and types of the above compounds.

Finished emulsions having been endowed with given grain conditions may be desalted according to conventional methods after the formation of the silver halide grains. The desalting may be carried out using a gelatin flocculating agent as disclosed in Japanese Patent O.P.I. Publications No. 243936/1988 and No. 185549/1989, or using noodle washing which is carried out by setting gelatin to gel. A coagulation method may also be used which utilizes inorganic salts comprised of a polyvalent anion, as exemplified by sodium sulfide, an anionic surface active agent and an anionic polymer (e.g., polystyrene sulfonic acid). In general, the silver halide emulsions having been desalted in this way are redispersed in gelatin and thus the emulsions are prepared.

In the light-sensitive material of the present invention, as silver halide grains, silver halide grains other than the silver halide grains of the present invention may be used in combination.

The silver halide grains used in combination may have any grain size distribution. Emulsions having a broad grain size distribution (called polydisperse emulsions) may be used, or monodisperse emulsions having a narrow grain size distribution may be used.

The light-sensitive material of the present invention is so formed that the silver halide grains of the present invention are contained in at least any one of silver halide emulsion layers that constitute the light-sensitive material. The silver halide grains other than the silver halide grains of the present invention may also be contained in the same layer.

In such an instance, the emulsion containing the silver halide grains of the present invention should preferably comprise not less than 20% by weight, and more preferably not less than 40% by weight.

In the case when the light-sensitive material has two or more silver halide emulsion layers, an emulsion layer comprised of only the silver halide grains other than the silver halide grains of the present invention may be present.

In such an instance, the emulsion of the present invention may preferably comprise not less than 10% by weight, and more preferably not less than 20% by weight, of the silver halide emulsions used for all light-sensitive layers that constitute the light-sensitive material.

In the present invention, a reduction sensitizer may preferably be used in combination. As a reducing agent, there are no particular limitations. It may include known stannous chloride, thiourea dioxide, ascorbic acid and derivatives thereof, hydrazine derivatives and polyamines. The reduction sensitization may preferably be carried out at a stage in the course of the growth of silver halide grains.

The silver halide grains of the present invention may also be optically sensitized to the desired wavelength region by the use of a spectral sensitizer.

The silver halide grains of the present invention may preferably be subjected to spectral sensitization.

The silver halide grains of the present invention may be spectrally sensitized using the spectral sensitizer as described in Research Disclosures on their volumes and pages as shown below. No. 17643, pages 23–24; No. 18716, pages 648–649; and No. 308119, page 996, paragraphs IV-A, -B, -C, -D, -H, -I, -J.

The effect obtained by the present invention becomes remarkable when the silver halide grains used in the present invention is spectrally sensitized. In particular, the effect of the present invention becomes more remarkable when a trimethine or monomethine cyanine dye is used alone or in combination with other spectral sensitizer. The silver halide grains other than the silver halide grains used in the present invention, optionally used in the light-sensitive material of the present invention may also be optically sensitized to the desired wavelength region.

In that instance, there are no particular limitations on the manner by which the optical sensitization is applied. For example, they may be optically sensitized using alone or in combination an optical sensitizer including a cyanine dye or merocyanine dye such as a xeromethine dye, a monomethine dye, a dimethine dye or a trimethine dye. Combination of spectral sensitizers is often used for the purpose of supersensitization. Together with the spectral sensitizers, a dye that has no spectral sensitization action in itself or a substance that absorbs substantially no visible light and exhibits supersensitization may be contained in the emulsions.

These techniques are disclosed in U.S. Pat. Nos. 2,688,545, 2,912,329, 3,397,060, 3,615,635 and 3,628,964, British Patents No. 1,195,302, No. 1,242,588 and No. 1,293,862, German Patent Publications (OLS) No. 20 30 326 and No. 21 21 786, Japanese Patent Examined Publication No. 14030/1968, and RD (Research Disclosure) Volume 176, No. 17643 (published December, 1978), page 23, paragraph IV-J. They may be optionally selected according to the wavelength region to which silver halide grains are to be sensitized, the sensitivity or the like and the purposes and uses of light-sensitive materials.

In working the present invention, various additives may be used in the light-sensitive material. For example, known photographic additives that can be used are exemplified in RD. Items described and paragraphs thereof are shown in the following table.

| Items | Page of RD308119, | RD17643, | RD18716 |
|---|---|---|---|
| Color contamination preventive agent | 1002 Par. VII-I | 25 | 650 |
| Color image stabilizer | 1001 Par. VII-J | 25 | |
| Brightening agent | 998 V | 24 | |
| Ultraviolet absorbent | 1003 Par. VIIIC XIIIC | 25–26 | |
| Light absorbing agent | 1003 Par. VIII | 25–26 | |

-continued

| Items | Page of RD308119, | RD17643, | RD18716 |
|---|---|---|---|
| Light scattering agent | 1003 Par. VIII | | |
| Filter dye | 1003 Par. VIII | 25–26 | |
| Binder | 1003 Par. IX | 26 | 651 |
| Antistatic agent | 1006 Par. XIII | 27 | 650 |
| Plasticizer | 1006 Par. XII | 27 | 650 |
| Lubricant | 1006 Par. XII | 27 | 650 |
| Surfactant, coating aid | 1005 Par. XI | 26–27 | 650 |
| Matting agent | 1007 Par. XVI | | |
| Developing agent (contained in light-sensitive materials) | 1011 Par. XX-B | | |

Various couplers can be used in the present invention. Examples thereof are described in the above RD. Related items described and paragraphs thereof are shown in the following table.

| Items | Page of RD308119 | RD17643 |
|---|---|---|
| Yellow coupler | 1001 Par. VII-D | Par. VII-C-G |
| Magenta coupler | 1001 Par. VII-D | Par. VII-C-G |
| Cyan coupler | 1001 Par. VII-D | Par. VII-C-G |
| Colored coupler | 1002 Par. VII-G | Par. VII-G |
| DIR coupler | 1001 Par. VII-F | Par. VII-F |
| BAR coupler | 1002 Par. VII-F | |
| Other useful residual group releasing coupler | 1001 Par. VII-F | |
| Alkali-soluble coupler | 1001 Par. VII-E | |

The additives used in the present invention can be added by the dispersion method as described in RD308119, paragraph XIV.

In the present invention, the supports as described in the aforesaid RD17643, page 28, RD18716, pages 647 to 648 and RD308119, paragraph XVII can be used.

The light-sensitive material of the present invention may also be provided with the auxiliary layers such as filter layers and intermediate layers as described in RD308119, paragraph VII-K.

The light-sensitive material used in the present invention may have various layer structures such as regular layer order, inverse layer order or unit structure as described in the aforesaid RD308119, paragraph VII-K.

The present invention can be preferably applied to various color light-sensitive materials as typified by co/or negative films for general use or motion picture, color reversal films for slide or television, color photographic papers, color positive films and color reversal papers.

The present invention can also be applied to a variety of uses for white and black general purpose, X-ray photography, infrared photography, microphotography, diffusion transfer process, reversal process and so forth.

The light-sensitive material of the present invention can be photographically processed by known methods conventionally used. For example, it can be photographically processed by conventional methods as described in RD17643, pages 28–29; RD18716, page 615 and RD308119, paragraph XIX.

EXAMPLES

The present invention will be specifically described below by giving Examples, to which the present invention is by no means limited.

Silver Halide Emulsion Preparation Example 1:

Preparation of octahedral silver bromide emulsion EM-1

| A monodisperse silver bromide seed emulsion was prepared using the following solutions A1 to E1. | |
|---|---|
| Solution A1: | |
| Ossein gelatin | 40 g |
| Potassium bromide | 1.48 g |
| Disodium propyleneoxy.polyethyleneoxy.disuccinate (10% methanol solution) | 20 ml |
| Using water, made up to | 9,200 ml |
| Solution B1: | |
| Ossein gelatin | 20.7 g |
| Potassium bromide | 49.4 g |
| Disodium propyleneoxy.polyethyleneoxy.disuccinate (10% methanol solution) | 3.8 ml |
| Using water, made up to | 2,070 ml |
| Solution C1: | |
| Ossein gelatin | 27.2 g |
| Potassium bromide | 648 g |
| Disodium propyleneoxy.polyethyleneoxy.disuccinate (10% methanol solution) | 9.5 ml |
| Using water, made up to | 2,716 ml |
| Solution D1: | |
| Silver nitrate | 70.4 g |
| Nitric acid (specific gravity: 1.38) | 4.2 ml |
| Using water, made up to | 2,070 ml |
| Solution E1: | |
| Silver nitrate | 1,086.2 g |
| Nitric acid (specific gravity: 1.38) | 9.1 ml |
| Using water, made up to | 2,716 ml |

To Solution A1 being vigorously stirred at 60° C., nitric acid was added to adjust the pH to 1.92. Subsequently, solutions B1 and D1 were added by the double jet method so as for their flow rate to be 29.6 ml/min at the start of the addition and 122.8 ml/min at the completion of the addition. After the addition of solution D1 was completed, the mixture was stirred for 1 minute, and then solutions C1 and E1 were added by the double jet method so as for their flow rate to be 10.4 ml/min at the start of the addition and 37.4 ml/min at the completion of the addition. During this addition, the pAg was maintained at 7.54.

One minute after the addition of solution E1 was completed, the pAg was adjusted to 9.46 using an aqueous 3.5N potassium bromide solution. After stirring for 2 minutes, the pH was adjusted to 5.5 using an aqueous potassium hydroxide solution (1.78N), and desalting was carried out by a conventional method, followed by addition of 113 g of ossein gelatin to give a monodisperse silver bromide seed emulsion with an average grain size of 0.27 μm.

Next, a monodisperse silver bromide emulsion was prepared using the resulting seed emulsion and the following solutions.

| | |
|---|---|
| Solution A2: | |
| Ossein gelatin | 102.2 g |
| Disodium propyleneoxy.polyethylene.disuccinate (10% methanol solution) | 30 ml |
| Using water, made up to | 9,600 ml |
| Solution B2: | |
| Ossein gelatin | 99 g |
| Potassium bromide | 1,237 g |
| Using water, made up to | 4,950 ml |
| Solution C2: | |
| Silver nitrate | 1,766 g |
| Aqueous 28% ammonia solution | 1,437 ml |
| Using water, made up to | 4,950 ml |
| Solution D2: | |

-continued

| | |
|---|---|
| Aqueous 56% acetic acid solution, in an amount necessary for pH adjustment | |
| Solution E2: | |
| Aqueous 2.1N potassium bromide solution, in an amount necessary for pAg adjustment | |
| Seed emulsion: | |
| Silver nitrate, in an amount corresponding to | 0.2087 mol |

To solution A2 being vigorously stirred at 40° C., the seed emulsion was added. After the pH and pAg were adjusted to 9.0 and 9.2, respectively, solutions B2 and C2 were added at the flow rate as shown in Table 1. During this addition, the pH and pAg were adjusted to the values as shown in Table 1, using solutions D2 and E2. One minute after the addition of solution C2 was completed, an aqueous 3.5N potassium bromide solution was added to adjust the pAg to 10.4.

After stirring for 5 minutes, the pH was adjusted to 6.0 using solution D2, and desalting was carried out by a conventional method, followed by addition of 169 g of ossein gelatin to give a monodisperse silver bromide emulsion EM-1 with an average grain size of 1.0 μm, a coefficient of variation of 8.2% and an octahedral crystal habit. Its pAg and pH were finally adjusted to 8.06 and 5.8, respectively.

TABLE 1

| Time | Flow rate of solutions B2,C2 (ml/min) | pH | PAg |
|---|---|---|---|
| 0 min 0 sec | 6.7 | 9.00 | 9.2 |
| 6 min 11 sec | 9.7 | 8.99 | 9.2 |
| 14 min 34 sec | 14.8 | 8.97 | 9.2 |
| 20 min 24 sec | 20.0 | 8.95 | 9.2 |
| 36 min 21 sec | 45.9 | 8.85 | 9.2 |
| 42 min 5 sec | 60.8 | 8.78 | 9.2 |
| 48 min 50 sec | 71.0 | 8.71 | 9.33 |
| 54 min 15 sec | 75.2 | 8.61 | 9.45 |
| 60 min 49 sec | 75.3 | 8.53 | 9.64 |
| 71 min 7 sec | 68.7 | 8.36 | 9.89 |
| 76 min 28 sec | 61.6 | 8.30 | 9.99 |
| 101 min 25 sec | 56.3 | 8.00 | 9.99 |

Silver Halide Emulsion Preparation Example 2:

Preparation of tabular silver bromide emulsion EM-2

| A monodisperse spherical seed emulsion was prepared using the following solutions A3 to D3 by the method disclosed in Japanese Patent O.P.I. Publication No. 6643/1986. | |
|---|---|
| Solution A3: | |
| Ossein gelatin | 150 g |
| Potassium bromide | 53.1 g |
| Potassium iodide | 24 g |
| Using water, made up to | 7.2 lit. |
| Solution B3: | |
| Silver nitrate | 1.5 g |
| Using water, made up to | 6 lit. |
| Solution C3: | |
| Potassium bromide | 1,327 g |
| 1-Phenyl-5-mercaptotetrazole (dissolved with methanol) | 0.3 g |
| Using water, made up to | 3 lit. |
| Solution D3: | |
| Ammonia water (28%) | 705 ml |

To solution A3 being vigorously stirred at 40° C., solutions B3 and C3 were added by the double jet method in seconds to effect formation of nuclei. At this stage, the pBr was 1.09 to 1.15.

After 1 minute 30 seconds, solution D3 was added in 20 seconds followed by ripening for 5 minutes. During the ripening, KBr was in a concentration of 0.071 mol/lit., and ammonia was in a concentration of 0.63 mol/lit.

Thereafter, the pH was adjusted to 6.0, immediately followed by desalting and washing with water. The resulting seed emulsion was observed using an electron microscope to reveal that it was a monodisperse spherical emulsion with an average gain size of 0.36 μm and a breadth of distribution of 18%.

Next, using this monodisperse spherical emulsion and the following emulsions, Emulsion EM-2 with an average silver iodide content of 8.0% was prepared by the following method.

| | |
|---|---|
| Solution A4: | |
| Ossein gelatin | 76.8 g |
| Potassium bromide | 3.0 g |
| Disodium propyleneoxy.polyethyleneoxy.disuccinate (10% methanol solution) | 10 ml |
| Spherical seed emulsion (set out above), in an amount corresponding to | 0.91 mol |
| Nitric acid (specific gravity: 1.38) | 4.5 ml |
| Using water, made up to | 4.0 lit. |
| Solution B4-1: | |
| Silver nitrate | 137.2 g |
| Nitric acid (specific gravity: 1.38) | 3.3 ml |
| Using water, made up to | 978 ml |
| Solution C4-1: | |
| Ossein gelatin | 39.1 g |
| Potassium bromide | 62.4 g |
| Potassium iodide | 46.8 g |
| Using water, made up to | 978 ml |
| Solution B4-2: | |
| Silver nitrate | 137.2 g |
| Nitric acid (specific gravity: 1.38) | 3.3 ml |
| Using water, made up to | 982 ml |
| Solution C4-2: | |
| Ossein gelatin | 39.3 g |
| Potassium bromide | 70.4 g |
| Potassium iodide | 36.3 g |
| Using water, made up to | 982 ml |
| Solution B4-3: | |
| Silver nitrate | 135.1 g |
| Nitric acid (specific gravity: 1.38) | 1.4 ml |
| Using water, made up to | 397 ml |
| Solution C4-3: | |
| Ossein gelatin | 15.8 g |
| Potassium bromide | 75.6 g |
| Potassium iodide | 26.4 g |
| Using water, made up to | 397 ml |
| Solution B4-4: | |
| Silver nitrate | 758.4 g |
| Nitric acid (specific gravity: 1.38) | 7.8 ml |
| Using water, made up to | 2,232 ml |
| Solution C4-4: | |
| Ossein gelatin | 89.3 g |
| Potassium bromide | 526 g |
| Potassium iodide | 7.41 g |
| Using water, made up to | 2,232 ml |

Using the apparatus disclosed in Japanese Patent O.P.I. Publication No. 160128/1987, feed nozzles connected to the lower portion of the mixing stirrer blade were set in such a manner that six nozzles were allotted for each B4-group solutions (solutions B4-1 to B4-4; used in changeover) and C4-group solutions (C4-1 to C4-4; used in changeover) so that feed solutions were divided into six portions.

To solution A2 being stirred at 75° C. and 450 rpm, solutions B4-1 and C4-1 were added by the double jet method so as for their flow rate to be 11.62 ml/min at the start of the addition and 22.91 ml/min at the completion of the addition. The flow rate in the course of the addition was linearly increased with respect to the time of addition, and the pAg was maintained at 8.3.

After the addition of solutions B4-1 and C4-1 was completed, the stirring speed was raised to 500 rpm.

Subsequently, to this solution being stirred, solutions B4-2 and C4-2 were added by the double jet method so as for their flow rate to be 22.91 ml/min at the start of the addition and 30.27 ml/min at the completion of the addition. The flow rate in the course of the addition was linearly increased with respect to the time of addition, and the pAg was maintained at 8.3. After the addition of solutions B4-2 and C4-2 was completed, the pAg was adjusted to 8.6 using an aqueous 3.5N potassium bromide solution.

Next, to this solution being stirred, solutions B4-3 and C4-3 were added by the double jet method so as for their flow rate to be 16.71 ml/min at the start of the addition and 18.63 ml/min at the completion of the addition. The flow rate in the course of the addition was linearly increased with respect to the time of addition, and the pAg was maintained at 8.6. After the addition of solutions B4-3 and C4-3 was completed, the stirring speed was raised to 550 rpm.

To this solution being stirred, solutions B4-4 and C4-4 were further added by the double jet method so as for their flow rate to be 41.19 ml/min at the start of the addition and 68.14 ml/min at the completion of the addition. The flow rate in the course of the addition was linearly increased with respect to the time of addition, and the pAg was maintained at 8.6.

After the addition was completed, the pH was adjusted to 6.0 using an aqueous potassium hydroxide solution (1.78N), and desalting was carried out by a conventional method, followed by addition of 98 g of ossein gelatin. The solution was made up to 3,400 ml in total quantity to give Emulsion EM-2. Its pAg and pH were finally adjusted to 8.0 and 6.0, respectively.

The emulsion EM-2 thus obtained was observed using an electron microscope to reveal that it had an average grain size of 1.24 μm and a coefficient of variation of 13.9%. Twinned grains of this emulsion, having an even-numbered twin planes, had a ratio of average diameter/grain thickness of 2.9 on the average.

Silver Halide Emulsion Preparation Example 3:

Preparation of tetradecahedral silver iodobromide emulsion EM-3

Using the seed emulsion produced in Example 1 and the following solutions, a monodisperse silver iodobromide emulsion with a silver iodide content of 10 mol % was prepared.

| | |
|---|---|
| Solution A5: | |
| Ossein gelatin | 157.2 g |
| Disodium propyleneoxy.polyethyleneoxy.disuccinate (10% methanol solution) | 20 ml |
| Aqueous 56% acetic acid solution | 1,000 ml |
| Aqueous 28% ammonia solution | 704 ml |
| Using water, made up to | 7,700 ml |
| Solution B5: | |
| Ossein gelatin | 100 g |
| Potassium bromide | 937.1 g |
| Potassium iodide | 145.3 g |
| Using water, made up to | 2,500 ml |
| Solution C5: | |
| Silver nitrate | 1,176.2 g |
| Aqueous 28% ammonia solution | 921 ml |

-continued

| | |
|---|---|
| Using water, made up to | 1,978 ml |
| Solution D5: | |
| Aqueous 56% acetic acid solution, in an amount necessary for pH adjustment | |
| Solution E5: | |
| Aqueous 2.1N potassium bromide solution | 125 g |
| Seed emulsion: | |
| Silver nitrate, in an amount corresponding to | 0.139 mol |

To solution A5 being vigorously stirred at 60° C., the seed emulsion was added. After the pH and pAg were adjusted to 7.0 and 7.8, respectively, solutions B5 and C5 were added at the flow rate as shown in Table 2. During this addition, the pH and pAg were maintained at 7.0 and 7.8, respectively, using solutions D5 and E5. One minute after the addition of solution C5 was completed, the pH was adjusted to 6.0 using solution D5, and desalting was carried out by a conventional method, followed by addition of 92.2 g of ossein gelatin to give emulsion EM-3. Its pH and pAg were finally adjusted to 5.8 and 8.06, respectively. Emulsion EM-3 was a monodisperse tetradecahedral emulsion having a silver iodide content of 10 mol % and an average grain size of 1.0 and comprised of (100) face and (111) face.

TABLE 2

| Time | Flow rate of solutions B5,C5 (ml/min) |
|---|---|
| | (ml/min) |
| 0 min 0 sec | 3.5 |
| 9 min 2 sec | 5.3 |
| 22 min 25 sec | 9.0 |
| 36 min 41 sec | 14.6 |
| 50 min 50 sec | 17.6 |
| 65 min 6 sec | 33.9 |
| 78 min 2 sec | 48.0 |
| 87 min 5 sec | 59.3 |

EXPERIMENT 1

Preparation of comparative emulsions A1, A2

At 50° C., the emulsion EM-1 in an amount corresponding to 1 mol of silver halide was made up to 550 ml using water and thereafter sodium thiosulfate was added in an amount of $1\times10^{-4}$ mol per mol of silver halide. The emulsion was made up to 620 ml in total quantity and then subjected to ripening. Upon ripening for 50 minutes and 120 minutes each, part of the emulsion was taken out and rapidly cooled to effect solidification. Comparative emulsions A1 and A2 were thus prepared.

Preparation of comparative emulsion B

Emulsion B was prepared in the same manner as emulsion A1 except that the sodium thiosulfate was replaced with 1-ethyl-3-(2-thiazolyl)thiourea added in an amount of $5\times10^{-5}$ mol per mol of silver halide and the ripening was carried out for 10 minutes.

Preparation of emulsion C (the invention)

Emulsion C was prepared in the same manner as emulsion A1 except that 120 minutes after the sodium thiosulfate was added 4-hydroxy-6-methyl-l,3,3a,7-tetrazaindene was added in an amount of 170 mg per mol of silver halide, and sodium thiosulfate was added after further 10 minutes in an amount of $5\times10^{-5}$ mol to carry out ripening for further 50 minutes, followed by cooling to effect solidification.

Preparation of emulsion D (the invention)

Emulsion D was prepared in the same manner as emulsion A1 except that 40 minutes after the sodium thiosulfate was added 1-ethyl-3-(2-thiazolyl)thiourea was added in an amount of $5\times10^{-5}$ mol per mol of silver halide, followed by cooling after further 10 minutes to effect solidification.

According to the gelatin shell method previously described, gelatin shell (replica) samples of emulsions A1 to D were prepared, and the distribution of chemically sensitizing nuclei contained in the shell was measured using a transmission electron microscope (Hitachi H-600 Type).

Results obtained are shown in Table 3. Size distribution curves of the sensitizing nuclei are also shown in FIG. 1.

TABLE 3

| Emulsion | Size distribution | Remarks |
|---|---|---|
| A1 | Single peak | Comparative; nuclei were formed on (111) faces. |
| A2 | Single peak | Comparative; nuclei were formed on (111) faces. |
| B | Single peak | Comparative; nuclei were formed on edges. |
| C | Double peaks | The invention; nuclei were formed on (111) faces. |
| D | Double peaks | The invention; nuclei were formed on edges (larger size side) and (111) faces (smaller size side). |

Preparation of comparative emulsion E

At 50° C., the emulsion EM-2 in an amount corresponding to 1 mol of silver halide was made up to 550 ml using water and thereafter sodium thiosulfate was added in an amount of $1\times10^{-4}$ mol per mol of silver halide. The emulsion was made up to 620 ml in total quantity and then subjected to ripening. The ripening was carried out for 140 minutes followed by cooling to effect solidification. Comparative emulsion E was thus obtained.

Preparation of comparative emulsion F

Emulsion F was prepared in the same manner as emulsion E except that the sodium thiosulfate was replaced with 1-ethyl-3-(2-thiazolyl)thiourea added in an amount of $5\times10^{-5}$ mol per mol of silver halide and the ripening was carried out for 10 minutes.

Preparation of comparative emulsion G Emulsion G was prepared in the same manner as emulsion E except that after the ripening was carried out for 140 minutes the emulsion temperature was dropped to 40° C. and chloroauric acid and ammonium thiocyanate were added in amounts of $2\times10^{-5}$ mol and $5\times10^{-5}$ mol, respectively, per mol of silver halide to carry out ripening for 20 minutes.

Preparation of comparative emulsion H

Emulsion H was prepared in the same manner as emulsion F except that after the ripening was carried out for 10 minutes the emulsion temperature was dropped to 40° C. and chloroauric acid and ammonium thiocyanate were added in amounts of $2\times10^{-5}$ mol and $5\times10^{-5}$ mol, respectively, per mol of silver halide to carry out ripening for 20 minutes.

Preparation of emulsion I (the invention)

Emulsion I was prepared in the same manner as emulsion E except that 40 minutes after the sodium thiosulfate was added 1-ethyl-3-(2-thiazolyl)thiourea was added in an amount of $5\times10^{-5}$ mol per mol of silver halide and after 10 minutes the solution was cooled to effect solidification.

Preparation of emulsion J (the invention)

Emulsion J was prepared in the same manner as emulsion I except that 10 minutes after the 1-ethyl-3-(2-thiazolyl)thiourea was added, the emulsion temperature was dropped to 40° C. and chloroauric acid was added in an amount of $2\times10^{-6}$ mol per mol of silver halide to carry out ripening for 20 minutes.

Preparation of comparative emulsion K

At 50° C., the emulsion EM-3 in an amount corresponding to 0.1 mol of silver halide was made up to 200 ml using water and thereafter sodium thiosulfate was added in an amount of $1\times10^{-4}$ mol per mol of silver halide. The emulsion was made up to 220 ml in total quantity and then subjected to ripening. The ripening was carried out for 120 minutes followed by cooling to effect solidification. Comparative emulsion K was thus obtained.

Preparation of comparative emulsion L

Emulsion L was prepared in the same manner as emulsion K except that the sodium thiosulfate was replaced with triethylthiourea added in an amount of $5\times10^{-5}$ mol per mol of silver halide and the ripening was carried out for 60 minutes.

Preparation of emulsion M (the invention)

Emulsion M was prepared in the same manner as emulsion K except that 60 minutes after the thiosulfate was added triethylthiourea was added in an amount of $5\times10^{-5}$ mol per mol of silver halide to carry out ripening for further 60 minutes.

For emulsions E to M each, the distribution of chemically sensitizing nuclei was measured in the same manner as for emulsion A1, using a transmission electron microscope. Results obtained are shown in Table 4. As is seen therefrom, the sensitizing nuclei of the emulsions prepared by the method of chemical sensitization as used in the present invention have a plurality of peaks in their size distribution. As is also seen therefrom, the 1-ethyl-3-(2-thiazolyl)thiourea and sodium thiosulfate or the triethylthiourea and sodium thiosulfate are sensitizers having different face selectivities.

TABLE 4

| Emulsion | Size distribution | Remarks |
|---|---|---|
| E | Single peak | Comparative; nuclei were formed on (111) faces. |
| F | Single peak | Comparative; nuclei were formed on edges. |
| G | Single peak | Comparative; nuclei were formed on (111) faces. |
| H | Single peak | Comparative; nuclei were formed on edges. |
| I | Double peaks | The invention; nuclei were formed on edges (larger size side) and (111) faces (smaller size side). |
| J | Double peaks | The invention; nuclei were formed on edges (larger size side) and (111) faces (smaller size side). |
| K | Single peak | Comparative; nuclei were formed on (111) faces and edges. |
| L | Single peak | Comparative; nuclei were formed on (111) faces. |
| M | Double peaks | The invention; nuclei were formed on the whole areas of grains. |

EXPERIMENT 2

Preparation of comparative sample a

At 50° C., the emulsion EM-1 in an amount corresponding to 1 mol of silver nitride was made up to 550 ml using water and thereafter sodium thiosulfate was added in an amount of $2\times10^{-6}$ mol per mol of silver halide. The emulsion was made up to 620 ml in total quantity and then subjected to ripening.

Two samples were prepared, one of which was a sample obtained 60 minutes after sodium thiosulfate was added and the other of which was a sample so made as to be at optimum in the relationship between sensitivity and fog after the addition of sodium thiosulfate. To each sample, 1.4 g per mol of silver halide, of 4-hydroxy-6-methyl-1,3,3a,7-tetrazaindene, 31 g of ossein Gelatin and 0.28 g of sodium triisopropylnaphthalenesulfonate were added. The resulting emulsions were each coated on a subbed triacetate cellulose support so as to Give a coated silver weight of 30 g/m$^2$, followed by drying to obtain corresponding samples a1 and a2. Under such chemical ripening conditions, the sensitivity obtained by exposure for 1/100 second was substantially at optimum when the ripening time was 120 minutes.

Preparation of comparative sample b

Sample b was prepared in the same manner as sample a2 except that the sodium thiosulfate was replaced with 1-ethyl-3-(2-thiazolyl)thiourea added in an amount of $1\times10^{-6}$ mol per mol of silver halide. The sensitivity obtained by exposure for 1/100 second was at optimum when the ripening time was 10 minutes.

Preparation of comparative sample c

Sample c was prepared in the same manner as sample al except that before the addition of sodium sulfate 170 mg per mol of silver halide, of 4-hydroxy-6-methyl-1,3,3a,7-tetrazaindene was added and 10 minutes after its addition $1\times10$ mol/mol.AgX of sodium thiosulfate was added to carry out ripening for 50 minutes.

Preparation of comparative sample d

Sample d was prepared in the same manner as sample al except that, in the preparation of sample a, 120 minutes after the addition of sodium sulfate 170 mg of 4-hydroxy-6-methyl-1,3,3a,7-tetrazaindene was added to carry out ripening for 60 minutes.

Preparation of sample e (the invention)

Sample e was prepared in the same manner as sample d except that, in the preparation of sample d, 10 minutes after the addition of 170 mg of tetrazaindene, sodium thiosulfate was added in an amount of $1\times10^{-6}$ mol per mol of silver halide to carry out ripening for further 50 minutes.

Preparation of sample f (the invention)

Sample f was prepared in the same manner as sample al except that, in the preparation of sample a1, 40 minutes after the addition of sodium thiosulfate, 1-ethyl-3-(2-thiazolyl)thiourea was added in an amount of $5\times10^{-5}$ mol per mol of silver halide to carry out ripening for further 10 minutes.

Preparation of reference sample

Emulsion EM-1 in an amount corresponding to 1 mol of silver halide was made up to 620 ml using water and 1.4 g per mol of silver halide, of 4-hydroxy-6-methyl-1,3,3a,7-tetrazaindene, 31 g of ossein gelatin and 0.28 g of sodium triisopropylnaphthalenesulfonate were added. The resulting emulsion was coated on a subbed triacetate cellulose support so as to give a coated silver weight of 30 g/m$^2$ followed by drying to obtain sample g.

Samples a to g were each exposed to blue light for 1/100 second, and processed by the surface development and internal development as described in the present specification to evaluate surface sensitivity and internal sensitivity. The sensitivity is determined as a reciprocal of the amount of exposure that gives a density of fog +0.1 and is indicated as a relative value assuming the sensitivity of sample g as 100. Results obtained are shown in Table 5.

TABLE 5

| Sample | Surface sensitivity | Internal sensitivity | Fog | Activation energy (eV) | Remarks |
|---|---|---|---|---|---|
| g | 100 | 100 | 0.06 | 0.26 | Reference |
| a1 | 310 | 150 | 0.08 | 0.26 | X |
| a2 | 1,100 | 10 | 0.12 | 0.21 | X |
| b | 1,050 | 5 | 0.14 | 0.11 | X |
| c | 190 | 180 | 0.08 | 0.26 | X |
| d | 1,150 | 10 | 0.11 | 0.21 | X |
| e | 1,400 | 10 | 0.11 | — | Y |
| f | 1,500 | 5 | 0.13 | — | Y |

X: Comparative Example, Y: Present Invention

As is clear from Table 5, all the chemically sensitizing nuclei of samples a to f bring about a more increase in surface sensitivity than internal sensitivity, based on reference sample g, a chemically unsensitized sample. The chemically sensitizing nuclei of sample e of the present invention are comprised of a combination of a1 and a2 or c and d, and those of sample f, a combination of al and b, where higher sensitivities than the sensitivities attained by the emulsions solely having individual kinds of sensitizing nuclei can be achieved without any sharp increase in fog.

Activation energy of free electron lifetime in the silver halide grains of each sample was also measured by the microwave photoconductivity measuring method as previously described. Results obtained are shown in Table 5 above.

This measurement was carried out using the same apparatus as previously described.

EXPERIMENT 3

Preparation of comparative sample h

At 50° C., the emulsion EM-2 in an amount corresponding to 1 mol of silver halide was made up to 550 ml using water and thereafter sodium thiosulfate was added in an amount of $2.1\times10^{-6}$ mol per mol of silver halide. The emulsion was made up to 620 ml in total quantity and then subjected to ripening. Sample h was prepared in the same manner as the sample a1 of Example 2 except that after 120 minutes the emulsion temperature was dropped to 40° C. and $6\times10^{-7}$ mol of sodium chloroauric acid and $5\times10^{-5}$ mol of ammonium thiocyante were added to carry out ripening for further 20 minutes. In this chemical ripening, an optimum time of the time of the ripening using sodium thiosulfate with respect to exposure for 1/100 seconds was 120 minutes.

Preparation of comparative sample i

Sample i was prepared in the same manner as sample h except that, after the addition of sodium thiosulfate, the ripening time before the temperature was dropped was changed to 40 minutes.

Preparation of comparative sample j

Sample j was prepared in the same manner as sample h except that the sodium thiosulfate was replaced with 1-ethyl-3-(2-thiazolyl)thiourea added in an amount of $7\times10^{-7}$ mol per mol of silver halide, the ripening was carried out for 10 minutes, the emulsion temperature was dropped to 40° C. and the chloroauric acid and ammonium thiocyanate were added in the same amounts as in the preparation of sample h. In this chemical sensitization, an optimum time of the time of the ripening using 1-ethyl-3-(2-thiazolyl)thiourea with respect to exposure for 1/100 second was 10 minutes.

Preparation of sample k (the invention)

Sample k was prepared in the same manner as sample h except that, 40 minutes after the addition of sodium thiosulfate, 1-ethyl-3-(2-thiazolyl)thiourea was added in an amount of $7\times10^{-7}$ mol per mol of silver halide to carry out ripening for further 10 minutes and thereafter the emulsion temperature was dropped to 40° C. and the chloroauric acid and ammonium thiocyanate were added in the same amounts as in the preparation of sample h.

Sample 1, coated with a chemically unsensitized emulsion, was prepared in the same manner as in Example 2.

The surface sensitivity and internal sensitivity of each sample were evaluated in the same manner as in Example 2. Results obtained are shown in Table 6. Results of measurement of surface sensitivity with respect to exposure for 8 seconds are also shown in Table 6.

TABLE 6

| Sample | Surface sensitivity | Internal sensitivity | Surface sensitivity (8 second exposure) | Fog | Remarks |
|---|---|---|---|---|---|
| l | 100 | 100 | 100 | 0.06 | Reference |
| h | 2,300 | 15 | 1,700 | 0.09 | X |
| i | 350 | 35 | 210 | 0.06 | X |
| j | 2,150 | 10 | 1,850 | 0.11 | X |
| k | 2,880 | 10 | 1,920 | 0.10 | Y |

X: Comparative Example, Y: Present Invention

As is clear from Table 6, all the chemically sensitizing nuclei of samples h to k bring about a more increase in surface sensitivity than internal sensitivity, based on reference sample 1, a chemically unsensitized sample. The chemically sensitizing nuclei of sample k of the present invention are comprised of a combination of the sensitizing nuclei of samples i and 3, where a higher sensitivity than the sensitivities attained by the emulsions solely having individual kinds of sensitizing nuclei can be achieved without any sharp increase in fog and also without any deterioration of the properties against low-intensity reciprocity law failure. It is also possible to achieve a higher sensitivity than the optimum sensitivities respectively attained by sodium thiosulfate and 1-ethyl-3-(2-thiazolyl)thiourea.

EXPERIMENT 4

At the stage of the preparation of samples h and j each in Example 3, spectral sensitizers SD-6, SD-7, SD-8 and SD-4 set out later were added in amounts of $1.2\times10^{-4}$ mol, $1.0\times10^{-4}$ mol, $3.4\times10^{-6}$ mol and $2.1\times10^{-5}$ mol, respectively, at the moment the ripening was carried out for 20 minutes after the dropping of emulsion temperature and addition of the gold sensitizer, followed by stirring for 30 minutes and thereafter addition of a stabilizer. Emulsions m, n and o were thus obtained.

Using the emulsion m, n or o in a high-speed green-sensitive emulsion layer, multi-layer light-sensitive photographic materials 101 to 103 as shown below were produced. In the following, the amount of each compound added in the light-sensitive material is indicated as gram number per 1 $m^2$ unless particularly noted. The amounts of silver halide and colloidal silver are in terms of silver weight. Those of spectral sensitizers are each indicated as molar number per mol of silver.

| | |
|---|---|
| First layer: Anti-halation layer HC-1 | |
| Black colloidal silver | 0.18 |
| Ultraviolet absorbent UV-1 | 0.23 |
| High-boiling solvent Oil-1 | 0.18 |
| Gelatin | 1.42 |
| Second layer: First intermediate layer IL-1 | |
| Gelatin | 1.27 |
| Third layer: Low-speed red-sensitive emulsion layer RL | layer |
| Monodisperse octahedral silver iodobromide emulsion (average grain size: 0.45 μm; average silver iodide content: 8.2 mol %) | 0.78 |
| Spectral sensitizer SD-1 | $1.8\times10^{-5}$ |
| Spectral sensitizer SD-2 | $2.8\times10^{-4}$ |
| Spectral sensitizer SD-3 | $3.0\times10^{-4}$ |
| Spectral sensitizer SD-4 | $4.1\times10^{-4}$ |
| Cyan coupler C-1 | 0.70 |
| Colored cyan coupler CC-1 | 0.066 |
| DIR compound D-1 | 0.028 |
| High-boiling solvent Oil-1 | 0.64 |
| Gelatin | 1.18 |
| Fourth layer: Medium-speed red-sensitive emulsion layer RM | |
| Monodisperse octahedral silver iodobromide emulsion (average grain size: 0.81 μm; average silver iodide content: 9.1 mol %) | 0.78 |
| Spectral sensitizer SD-1 | $2.1\times10^{-5}$ |
| Spectral sensitizer SD-2 | $1.9\times10^{-4}$ |
| Spectral sensitizer SD-3 | $9.6\times10^{-5}$ |
| Spectral sensitizer SD-4 | $9.6\times10^{-5}$ |
| Cyan coupler C-1 | 0.28 |
| Colored cyan coupler CC-1 | 0.027 |
| DIR compound D-1 | 0.011 |
| High-boiling solvent Oil-1 | 0.26 |
| Gelatin | 0.58 |
| Fifth layer: High-speed red-sensitive emulsion layer RH | |
| Monodisperse silver iodobromide emulsion (average grain size: 0.99 μm; average silver iodide content: 8.0 mol %) | 1.73 |
| Spectral sensitizer SD-1 | $1.9\times10^{-5}$ |
| Spectral sensitizer SD-2 | $1.7\times10^{-4}$ |
| Spectral sensitizer SD-3 | $1.7\times10^{-4}$ |
| Cyan coupler C-2 | 0.14 |
| DIR compound D-1 | 0.025 |
| High-boiling solvent Oil-1 | 0.17 |
| Gelatin | 1.24 |
| Sixth layer: Second intermediate layer IL-2 | |
| Gelatin | 0.80 |
| Seventh layer: Low-speed green-sensitive emulsion layer GL | |
| Monodisperse octahedral silver iodobromide emulsion (average grain size: 0.45 μm; average silver iodide content: 8.2 mol %) | 0.98 |
| Spectral sensitizer SD-4 | $6.8\times10^{-5}$ |
| Spectral sensitizer SD-5 | $6.2\times10^{-4}$ |
| Magenta coupler M-1 | 0.54 |
| Magenta coupler M-2 | 0.19 |
| Colored magenta coupler CM-1 | 0.06 |
| DIR compound D-2 | 0.017 |
| High-boiling solvent Oil-2 | 0.81 |
| Gelatin | 1.77 |
| Eighth layer: Medium-speed green-sensitive emulsion layer GM | |
| Monodisperse octahedral silver iodobromide emulsion (average grain size: 0.81 μm; average silver iodide content: 9.1 mol %) | 0.66 |
| Spectral sensitizer SD-6 | $1.9\times10^{-4}$ |
| Spectral sensitizer SD-7 | $1.2\times10^{-4}$ |
| Spectral sensitizer SD-8 | $1.5\times10^{-5}$ |
| Spectral sensitizer SD-4 | $8.2\times10^{-5}$ |
| Magenta coupler M-1 | 0.074 |
| Magenta coupler M-2 | 0.034 |
| Colored magenta coupler CM-1 | 0.043 |
| DIR compound D-2 | 0.018 |

-continued

| | |
|---|---|
| High-boiling solvent Oil-2 | 0.30 |
| Gelatin | 0.76 |
| Ninth layer: High-speed green-sensitive emulsion layer GH | |
| Emulsion m, n or o | 1.65 |
| Magenta coupler M-1 | 0.094 |
| Magenta coupler M-3 | 0.044 |
| Colored magenta coupler CM-1 | 0.038 |
| High-boiling solvent Oil-2 | 0.31 |
| Gelatin | 1.23 |
| Tenth layer: Yellow filter layer YC | |
| Yellow colloidal silver | 0.05 |
| Color stain preventive agent SC-1 | 0.1 |
| High-boiling solvent Oil-2 | 0.125 |
| Gelatin | 1.33 |
| Formalin scavenger HS-1 | 0.088 |
| Formalin scavenger HS-2 | 0.066 |
| Eleventh layer: Low-speed blue-sensitive emulsion layer BL | |
| Monodisperse octahedral silver iodobromide emulsion (average grain size: 0.45 μm; average silver iodide content: 8.2 mol %) | 0.25 |
| Monodisperse octahedral silver iodobromide emulsion (average grain size: 0.81 μm; average silver iodide content: 9.1 mol %) | 0.12 |
| Spectral sensitizer SD-9 | $5.2 \times 10^{-4}$ |
| Spectral sensitizer SD-10 | $1.9 \times 10^{-5}$ |
| Yellow coupler Y-1 | 0.65 |
| Yellow coupler Y-2 | 0.24 |
| High-boiling solvent Oil-2 | 0.18 |
| Gelatin | 1.25 |
| Formalin scavenger HS-1 | 0.08 |
| Twelfth layer: High-speed blue-sensitive emulsion layer BH | |
| Monodisperse silver iodobromide emulsion (average grain size: 1.2 μm; average silver iodide content: 8.2 mol %) | 1.80 |
| Yellow coupler Y-1 | 0.18 |
| High-boiling solvent Oil-2 | 0.074 |
| Gelatin | 1.30 |
| Formalin scavenger HS-1 | 0.05 |
| Formalin scavenger HS-2 | 0.12 |
| Thirteenth layer: First protective layer PRO-1 | |
| Fine grain silver iodobromide emulsion (average grain size: 0.08 μm; AgI content: 1 mol %) | 0.4 |
| Ultraviolet absorbent UV-1 | 0.07 |
| Ultraviolet absorbent UV-2 | 0.10 |
| High-boiling solvent Oil-1 | 0.07 |
| High-boiling solvent Oil-3 | 0.07 |
| Formalin scavenger HS-1 | 0.13 |
| Formalin scavenger HS-2 | 0.37 |
| Gelatin | 1.3 |
| Fourteenth layer: Second protective layer PRO-2 | |
| Alkali-soluble matting agent (average particle diameter: 2 μm) | 0.13 |
| Polymethyl methacrylate (average particle diameter: 3 μm) | 0.02 |
| Lubricant WAX-1 | 0.04 |
| Gelatin | 0.6 |

Coating aid Su-1, dispersion aid Su-2, a viscosity modifier, hardening agents H-1 and H-2, stabilizer ST-1, and antifoggants AF-1, and AF-2 in two kinds with Mw 10,000 and Mw 1,100,000 were added to each layer in addition to the above compounds.

C-1

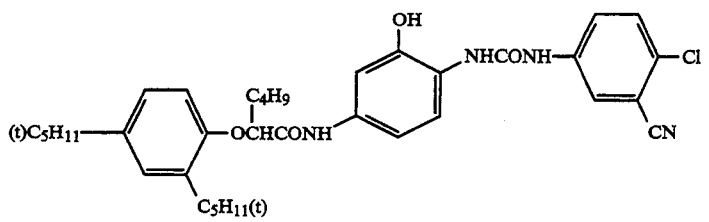

C-2

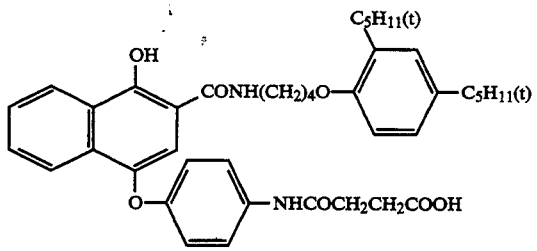

M-1

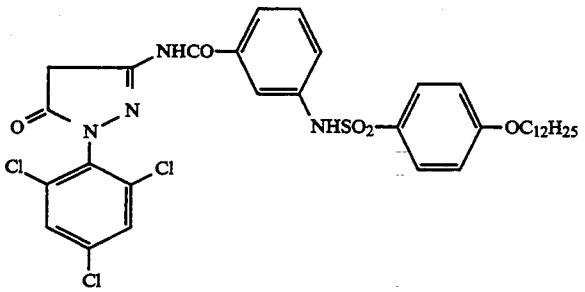

-continued
M-2
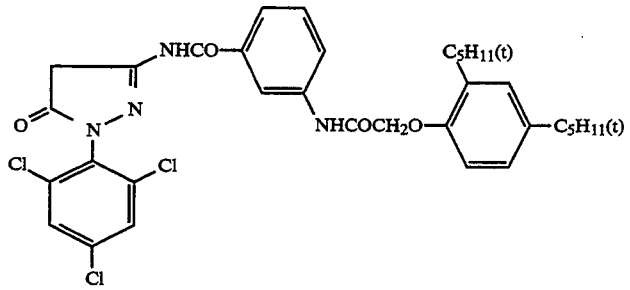
M-3
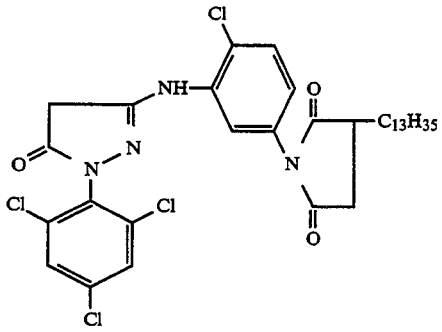
Y-1
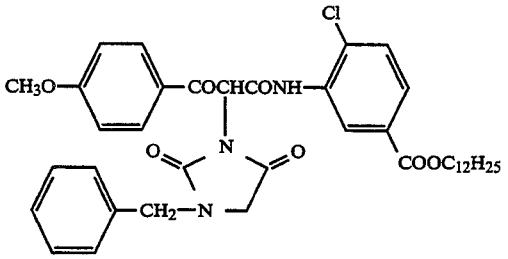
Y-2
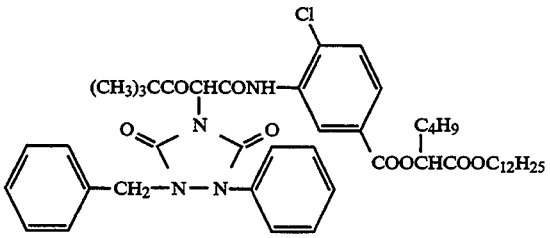
CC-1
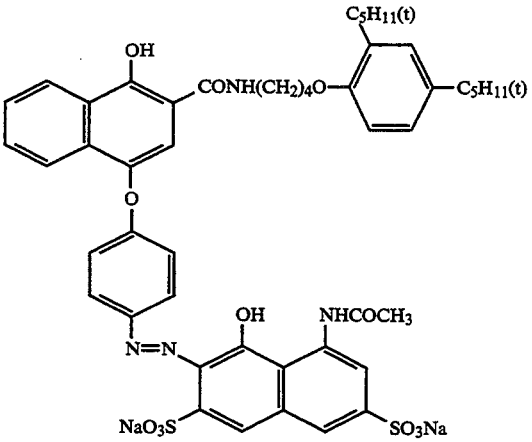

-continued
CM-1
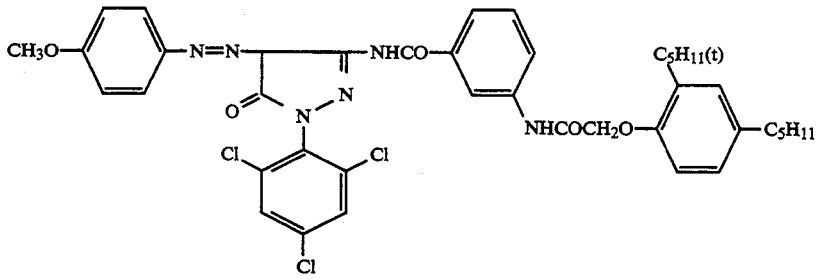
D-1
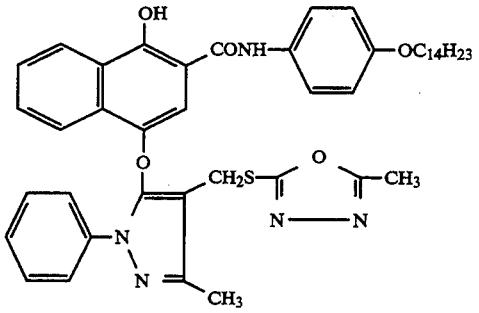
D-2
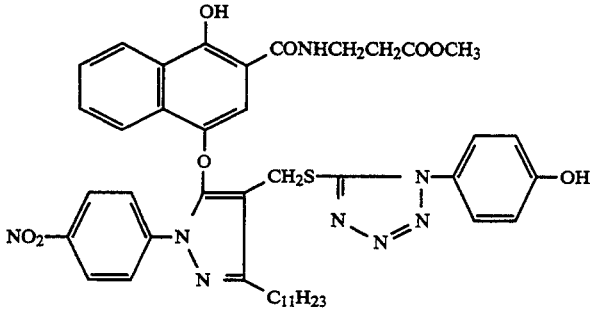
Oil-1
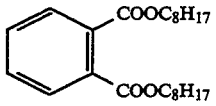
Oil-2
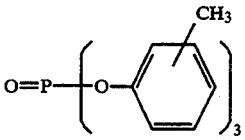
Oil-3
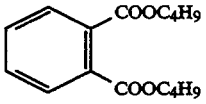
SC-1
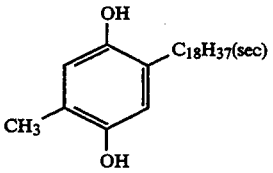
UV-1
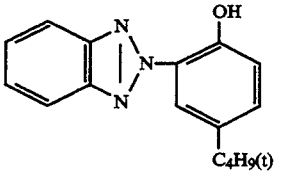

-continued
UV-2
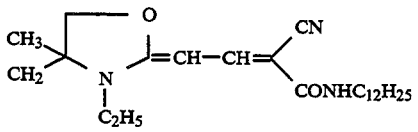
WAX-1
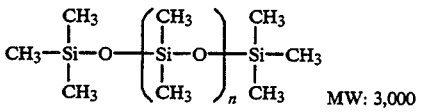
MW: 3,000
SU-1
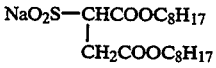
SU-2
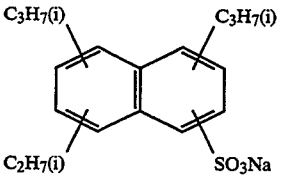
HS-1
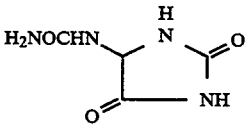
HS-2
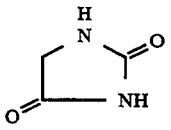
SD-1
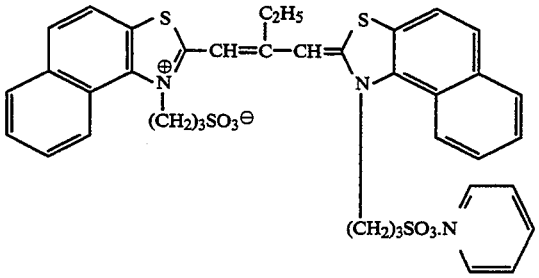
SD-2
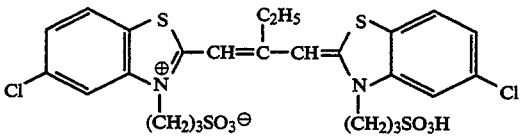
SD-3
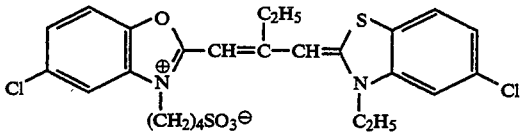
SD-4
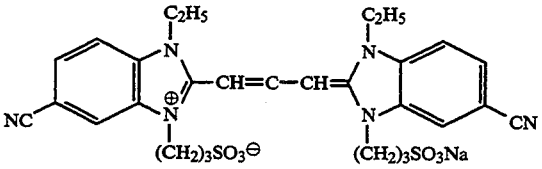

-continued
SD-5
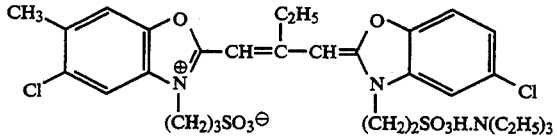
SD-6
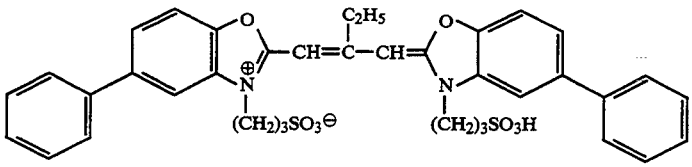
SD-7
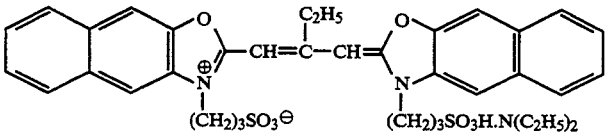
SD-8
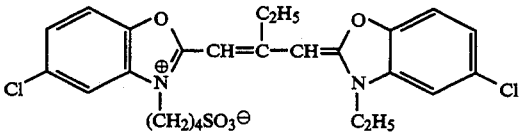
SD-9
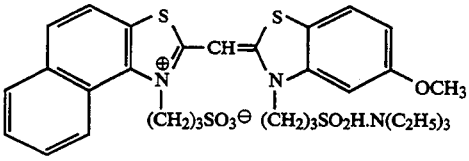
SD-10
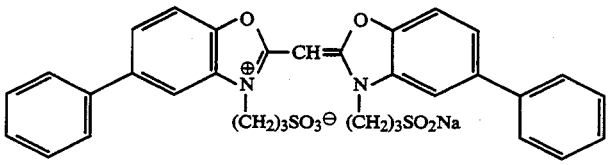
H-1
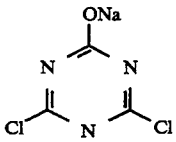
$(CH_2{=}CHSO_2CH_2)_2O$ H-2
ST-1
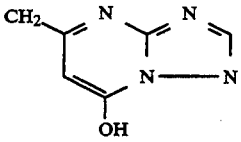
AF-1
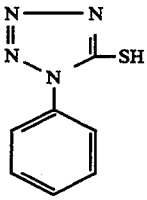

-continued

AF-2

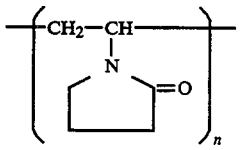

These multi-layer samples were each exposed to blue light for 1/100 second, and color-processed according to the following color photographic processing steps to compare and evaluate sensitivities. Results obtained are shown in Table 7. The sensitivity set out in Table 7 is determined as a reciprocal of the amount of exposure that gives a density of fog +0.1, and is indicated as a relative value for each amount of exposure, assuming the sensitivity of sample 101 as 100.

Processing steps

| Processing steps | Processing temp. | Processing time |
|---|---|---|
| Color developing | 38° C. | 3 min 15 sec |
| Bleaching | 38° C. | 6 min 30 sec |
| Washing | 38° C. | 3 min 15 sec |
| Fixing | 38° C. | 6 min 30 sec |
| Washing | 38° C. | 3 min 15 sec |
| Stabilizing | 38° C. | 1 min 30 sec |
| Drying | 38° C. | |

Processing solutions used in the respective processing steps had the following composition.

| | |
|---|---|
| Color developing solution | |
| 4-Amino-3-methyl-N-ethyl-N-(β-hydroxyethyl)aniline·sulfate | 4.75 g |
| Anhydrous sodium sulfite | 4.25 g |
| Hydroxyamine·½ sulfate | 2.0 g |
| Anhydrous potassium carbonate | 37.5 |
| Sodium bromide | 1.3 g |
| Trisodium nitrilotriacetatate (monohydrate) | 2.5 g |
| Potassium hydroxide | 1.0 g |
| Made up to 1 liter by adding water and adjusted to pH using sodium hydroxide. | 10.6 |
| Bleaching solution | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 g |
| Made up to 1 liter by adding water, and adjusted to pH using ammonium water. | 6.0 |
| Fixing solution | |
| Ammonium thiosulfate | 175.0 g |
| Anhydrous sodium sulfite | 8.6 g |
| Sodium metasulfite | 2.3 g |
| Made up to 1 liter by adding water, and adjusted to pH using acetic acid. | 6.0 |
| Stabilizing solution | |
| Formalin (aqueous 37% solution) | 1.5 ml |
| KONIDAX (available from KONICA CORPORATION) | 7.5 ml |
| Made up to 1 liter by adding water. | |

TABLE 7

| Sample | Emulsion | 1/100 sec exposure sensitivity | 8 sec exposure sensitivity | Remarks |
|---|---|---|---|---|
| 101 | m | 100 | 100 | X |
| 102 | n | 85 | 121 | X |
| 103 | o | 128 | 133 | Y |

X: Comparative Example, Y: Present Invention

As is clear from Table 7, the samples making use of the emulsion of the present invention can achieve a high sensitivity without any deterioration of the properties against low-intensity reciprocity law failure not only in the case when used in multi-layer light-sensitive materials but also when subjected to spectral sensitization.

As having been described above, in the present invention, silver halide grains have, on each grain, the chemically sensitizing nuclei having at least two distinctive peaks in their size distribution. Hence it is possible to obtain a silver halide photographic emulsion having a high sensitivity and low fog and also having superior properties against low-intensity reciprocity-law failure.

EXPERIMENT 5

Emulsions a1 and b as prepared in Experiment 2 were mixed in the mixing ratio as shown in Table 8, and then coated on a triacetate cellulose support in the same manner as in Experiment 2, followed by drying to give samples 501 to 503. These samples were each exposed to blue light for 1/100 second, and the surface sensitivity and internal sensitivity as described in the present specification were evaluated to make comparison with the emulsions a, b, e and f prepared in Experiment 2. The sensitivity is determined as a reciprocal of the amount of exposure that gives a density of fog +0.1 and is indicated as a relative value assuming the sensitivity of sample a1 as 100. Results obtained are shown in Table 8.

TABLE 8

| Sample | Surface sensitivity | Internal sensitivity | Fog | Remarks |
|---|---|---|---|---|
| a1 | 100 | 100 | 0.08 | X |
| b | 340 | 3 | 0.14 | X |
| 501 | 270 | 15 | 0.10 | X; mixing ratio of emulsions a1 & b: 1:2 |
| 502 | 180 | 35 | 0.11 | X; mixing ratio of emulsions a1 & b: 1:1 |
| 503 | 115 | 60 | 0.09 | X; mixing ratio of emulsions a1 & b: 2:1 |
| e | 450 | 7 | 0.11 | Y |
| f | 480 | 3 | 0.13 | Y |

X: Comparative Example, Y: Present Invention

Silver halide grains of the emulsions 501 to 503 are comprised of a mixture of the silver halide grains contained in the emulsion a1 and b. As emulsions as a whole, they have chemically sensitizing nuclei having two different activation energies.

However, the sensitivities of the samples 501 to 503 are lower than the sensitivity of the emulsion b having been not mixed, and lower than the sensitivities of the samples e and f of the present invention. Hence, this effect can be said to be attributable to the presence of the chemically sensitizing nuclei on one grain that have a plurality of distinctive peeks in their size distribution.

What is claimed is:

1. A silver halide photographic emulsion containing silver halide grains having thereon chemically sensitized nuclei, said chemically sensitized nuclei comprising at least two distinctive groups in size distribution, each group contains a chalcogenide, and each group is capable of increasing surface sensitivity of the emulsion.

2. The silver halide photographic emulsion of claim 1, wherein the silver halide grains each have a crystal surface consisting of at least two crystal faces with different face indices from each other, and the chemically sensitized nuclei formed on one of said at least two crystal faces being different in their size distribution from the chemically sensitized nuclei formed on another of said at least two crystal faces.

3. The silver halide photographic emulsion of claim 2, wherein said chemically sensitized nuclei are produced by adding at least two different kinds of chalcogen-containing compounds to said silver halide grains.

4. The silver halide photographic emulsion of claim 3, wherein said at least two chalcogen-containing compounds have different face selectivities.

5. The silver halide photographic emulsion of claim 1, wherein said chemically sensitized nuclei provide a size distribution curve having at least two distinctive peaks.

6. A silver halide photographic material comprising a support having thereon at least one layer, wherein said layer comprises the silver halide emulsion as claimed in claim 1.

* * * * *

UNITED STATES PATENT AND TRADEMARK OFFICE

CERTIFICATE OF CORRECTION

PATENT NO. : 5,389,511

DATED : February 14, 1995

INVENTOR(S) : Tomoyuki Nakayama

It is certified that error appears in the above-indentified patent and that said Letters Patent is hereby corrected as shown below:

Claim 2, Column 37, Line 5, "consisting of" should read --comprising--.

Signed and Sealed this

Twenty-third Day of May, 1995

*Attest:*

*Attesting Officer*

BRUCE LEHMAN

*Commissioner of Patents and Trademarks*